US008494421B2

(12) United States Patent
Roetker et al.

(10) Patent No.: US 8,494,421 B2
(45) Date of Patent: Jul. 23, 2013

(54) SEAMLESS INTERMEDIATE TRANSFER BELT

(75) Inventors: Michael S Roetker, Webster, NY (US); Francisco J Lopez, Rochester, NY (US); Kyle B Tallman, Farmington, NY (US); Jonathan H Herko, Walworth, NY (US); David W Martin, Walworth, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 279 days.

(21) Appl. No.: 13/024,494

(22) Filed: Feb. 10, 2011

(65) Prior Publication Data

US 2012/0207519 A1 Aug. 16, 2012

(51) Int. Cl.
*G03G 15/01* (2006.01)

(52) U.S. Cl.
USPC ..... 399/302

(58) Field of Classification Search
USPC ..... 399/302; 264/216; 977/742, 932; 521/25
See application file for complete search history.

(56) References Cited

U.S. PATENT DOCUMENTS

| | | | | |
|---|---|---|---|---|
| 2010/0051423 | A1 | 3/2010 | Kim et al. | |
| 2010/0239764 | A1 | 9/2010 | Ichizawa et al. | |
| 2010/0247891 | A1 * | 9/2010 | Chang et al. | 428/220 |
| 2012/0015153 | A1 * | 1/2012 | Mishra et al. | 428/174 |
| 2012/0049123 | A1 * | 3/2012 | Wu | 252/500 |

OTHER PUBLICATIONS

Foley et al., "UV Cured Heterogeneous Intermediate Transfer Belts (ITB)", U.S. Appl. No. 12/624,589, filed Nov. 24, 2009.
Foley et al., "Intermediate Transfer Belts", U.S. Appl. No. 12/731,449, filed Mar. 25, 2010.

* cited by examiner

*Primary Examiner* — G. M. Hyder
(74) *Attorney, Agent, or Firm* — MH2 Technology Law Group LLP

(57) ABSTRACT

An intermediate transfer belt for an electrostatographic device and methods for making the intermediate transfer belt can include the use of polyamide-imide and carbon nanotubes and nanosheets, for example multi-walled carbon nanotubes, single-walled carbon nanotubes, graphene, graphite, and two or more of these as an electrically conductive filler.

18 Claims, 1 Drawing Sheet

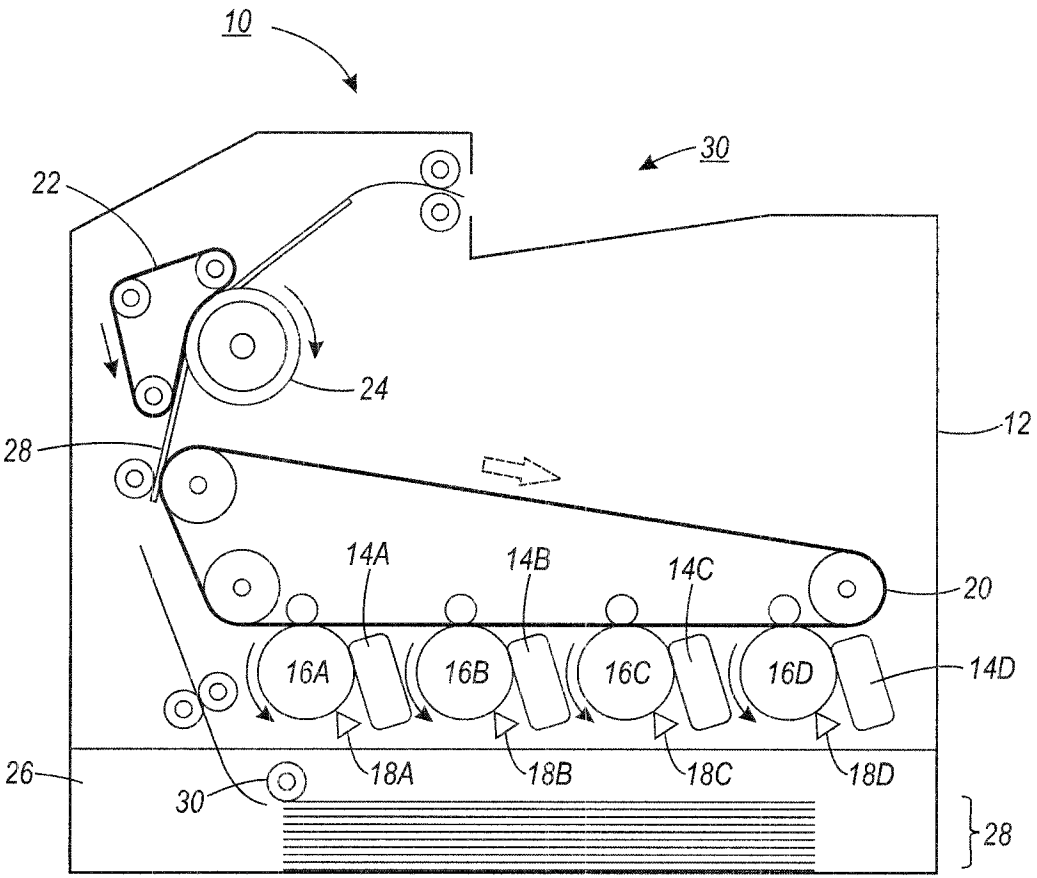
10
12
14A
14B
14C
14D
16A
16B
16C
16D
18A
18B
18C
18D
20
22
24
26
28
28
30
30

SEAMLESS INTERMEDIATE TRANSFER BELT

FIELD OF THE INVENTION

The present teachings relate generally to intermediate transfer belts used for electrostatographic devices and, more particularly, to methods and compositions for intermediate transfer belts.

BACKGROUND OF THE INVENTION

In a typical electrostatographic reproducing apparatus, a light image of an original to be copied can be recorded in the form of an electrostatic latent image upon a photosensitive member or a photoconductor (i.e., drum), and the latent image is subsequently rendered visible by the application of electroscopic particles, such as thermoplastic resin, and colorants. Generally, the electrostatic latent image is developed by contacting it with a developer mixture. The developer mixture can include a dry developer mixture, which can include carrier granules having toner particles, which may adhere to the latent image through triboelectric charging, or a liquid developer material which may include a liquid carrier having toner particles dispersed therein. The developer material is advanced into contact with the electrostatic latent image, and the toner particles are deposited onto the latent image to develop the image.

Once formed on the photoconductor, the toner image is transferred to an intermediate transfer belt (ITB). Subsequently, the developed image is transferred from the ITB to a permanent substrate, such as a sheet of plain paper, plastic, etc. The toner image is typically fixed or fused upon the permanent substrate through the application of heat and pressure to the toner and substrate.

One consideration for ITB production is manufacturing costs. One approach for achieving a low cost target is to reduce the cost of raw materials. ITBs can be manufactured, for example, using a base material of polyimide and an electrically conductive filler of carbon black. However, a low cost ITB tends to have low performance which can result in reduced image quality and poor ITB durability. Other problems found with low performance products include excessive wear, belt creep which can lead to misaligned image colors, and chemical or environmental damage resulting from image forming chemicals or harsh environmental conditions within the device. Thus the production of a ITB having a good balance between cost and performance is an ongoing engineering design goal.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

One embodiment of the present teachings can include a method for forming an intermediate transfer belt, including forming a liquid coating solution using a method including combining a polyamide-imide component including a mixture of about 25 wt % polyamide-imide and about 75 wt % solvent with a carbon nanotube component including a mixture of about 1 wt % carbon nanotubes and about 99 wt % solvent, wherein the polyamide-imide component within the liquid coating solution includes between about 60 wt % and about 80 wt % and the carbon nanotube component within the coating solution includes between about 6.0 wt % and about 12.0 wt %. The method can also include applying the liquid coating solution to a solid substrate, curing the liquid coating solution, and removing the cured liquid coating solution from the solid substrate. The present teachings can provide a belt that exhibits good physical characteristics, for example Young's modulus, break strength, and surface resistivity as discussed below, and can be manufactured at a reasonable cost.

Another embodiment of the present teachings can include an intermediate transfer belt for an electrostatographic image forming device including a polyamide-imide comprising between about 10 wt % and about 99.9 wt % of the intermediate transfer belt and a plurality of carbon nanotubes comprising between about 0.01 wt % and about 6.0 wt % of the intermediate transfer belt, wherein the intermediate transfer belt has a Young's modulus of between about 1000 MPa and about 10000 MPa.

Another embodiment of the present teachings can include an electrostatographic image forming apparatus including an intermediate transfer belt. The intermediate transfer belt can include a polyamide-imide comprising between about 10 wt % and about 99.9 wt % of the intermediate transfer belt and a plurality of carbon nanotubes comprising between about 0.01 wt % and about 6.0 wt % of the intermediate transfer belt, wherein the intermediate transfer belt has a Young's modulus of between about 1000 MPa and about 10000 MPa. The electrostatic image forming apparatus can further include at least one photoreceptor configured to receive a latent image and at least one charging device configured to write the latent image onto the at least one photoreceptor, wherein the intermediate transfer belt is configured to receive a toner image from the at least one photoreceptor.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures:

FIG. 1 is a cross section of an electrostatographic printing device which includes an intermediate transfer belt according to the present teachings.

It should be noted that some details of the FIG. have been simplified and are drawn to facilitate understanding of the present teachings rather than to maintain strict structural accuracy, detail, and scale.

DESCRIPTION OF THE EMBODIMENTS

Reference will now be made in detail to the embodiments of the present teachings, examples of which are illustrated in the accompanying drawing. Wherever possible, the same reference numbers will be used throughout the drawings to refer to the same or like parts.

As used herein, the word "printer" encompasses any apparatus, such as an electrostatographic image forming apparatus, that performs a print outputting function for any purpose, such as a digital copier, bookmaking machine, facsimile machine, a multi-function machine, etc. The word "polyamide-imide" encompasses polymeric materials having both amide groups and imide groups. The ratio of the two groups can be varied according to the expected resulting physical properties. The amide groups or the imide groups can be present in main molecular chains and/or side molecular chains.

Embodiments of the present teachings can include an intermediate transfer belt (ITB) having a composition and methods of forming an ITB having the composition, for example a seamless ITB. Additionally, embodiments can include devices which incorporate an ITB according to the present teachings.

ITBs can include a base material which forms the bulk of the structure, and may include a coating. In embodiments of the present teachings, the base material can include a polyamide-imide (PAI) binder with an electrically conductive filler to establish a particular surface resistivity. In an embodiment, the electrically conductive filler can include carbon nanotubes (CNT) and nanosheets, for example multi-walled CNTs (MWCNTs), single-walled CNTs (SWCNTs), graphene, graphite, and combinations of two or more of these, referred to herein collectively as CNTs. MWCNTs can have a lower cost than SWCNTs.

The preparation of samples described herein included a similar preparation process for each sample, with the relative quantities of the MWCNT solution varying as described below.

To prepare the ITB material, Torlon® 4000T polyamide-imide, available from Solvay Advanced Polymers of Brussels, Belgium, was used as the PAI component. The Torlon 4000T is provided as a 25% solution by weight (i.e. "wt %") of PAI in a quantity of solvent, specifically polyamide-imide/N-methyl-2-pyrrolidone (NMP). During experimental testing, 30 g of this Torlon solution was used. To prepare the ITB material, an additional 10 g of NMP was provided within the solution.

To provide proper electrical conduction, this PAI mixture was combined with a quantity of MWCNTs as an electrically conductive filler. The MWCNT was supplied within a dispersion of methylene chloride, to provide a 1 wt % solution of MWCNT within 99 wt % methylene chloride. A suitable commercial MWCNT dispersion, Nanosolve, is available from Zyvex Performance Materials of Columbus, Ohio.

To ensure proper coating of the ITB base solution onto a solid substrate during ITB formation, a non-ionic surfactant (0.30 g) and a fluorosurfactant (0.05 g) was provided in the liquid coating solution. A suitable non-ionic surfactant includes Stepfac-8171 available from Stepan Products of Northfield, Ill. A suitable fluorosurfactant includes Novec™ FC-4432 available from 3M of St. Paul, Minn.

After combining these materials in the quantities listed in Table 1 below, the mixtures were milled by stainless steel beads for 24 hours. Subsequent to milling, the milling medium was filtered off, then the collected solution was dispensed onto a solid substrate using a 10-mil Bird bar. The coatings were dried and cured to a flexible solid state by using a first heating stage at a temperature of 85° C. for 30 minutes, followed by a second heating stage at a temperature of 190° C. for 45 minutes. Subsequent to curing, the resulting ITBs had a nominal thickness in the range of between about 1 mil to about 6 mil.

Table 1 below shows the material quantities for each of three testing samples. Only the quantity of the MWCNT 1 wt % solution was changed.

TABLE 1

Sample Components

| | Sample A | Sample B | Sample C |
|---|---|---|---|
| 25% Torlon 4000T in NMP | 30.0 g | 30.0 g | 30.0 g |
| StepFac-8171 | 0.30 g | 0.30 g | 0.30 g |
| Fluorosurfactant FC-4432 | 0.05 g | 0.05 g | 0.05 g |
| 1% Nanosolve MWCNT Solution | 5.25 g | 3.75 g | 2.65 g |
| NMP | 10.0 g | 10.0 g | 10.0 g |

Generally, intermediate transfer belts are targeted for specific characteristics. For example, ITBs can be targeted to have a surface resistivity in the range of from about 9.0Ω/□ to about 11.0Ω/□, as measured by common logarithm.

Each of the testing samples produced varying performance characteristics. Table 2 below summarizes the surface resistivity for each of the samples at various applied voltages.

TABLE 2

Sample Surface Resistivity (Ω/□) for Various Applied Voltages

| | Sample A | Sample B | Sample C |
|---|---|---|---|
| 10 volts | 1.66E+08 | 1.96E+10 | >1.0E+14 |
| 100 volts | 1.17E+08 | 4.39E+09 | >1.0E+14 |
| 250 volts | 1.01E+08 | 3.04E+09 | >1.0E+14 |
| 500 volts | 8.52E+07 | 2.05E+09 | >1.0E+14 |
| 1000 volts | <1.0E+06 | 9.61E+08 | 3.74E+13 |

Additionally, the ITBs should be sufficiently flexible and break resistant. Table 3 below shows the tensile modulus (Young's modulus) and break strength measured in megapascals (MPa) for each of the samples.

TABLE 3

Sample Flexibility and Strength

| | Sample A | Sample B | Sample C |
|---|---|---|---|
| Young's Modulus | 3208.44 MPa | 3410.69 MPa | 3914.76 MPa |
| Break Strength | 94.4 MPa | 114.45 MPa | 111.3 MPa |

The MWCNT dispersion demonstrated excellent stability when mixed with the PAI. The cured films were removed from the stainless steel substrate with little difficulty, and had a shiny, smooth surface. Sample C displayed good transparency.

Sample B, while including only 0.5 wt. % MWCNT within the ITB film, had a measured surface resistivity of 9.61E+08Ω/□ at 1000 volts. Thus while MWCNTs can be much more expensive than the same quantity of other electrically conductive fillers such as carbon black, the ITB film according to embodiments can use CNTs, for example MWCNTs, at a quantity which is 1/30 of the amount of carbon black required to achieve a desired surface resistivity. Additionally, the cost of PAI is generally less expensive than other materials such as polyimide. Thus the cost of materials, and thus of the completed belt, can be less when using MWCNT.

Because of the high surface resistivity desired for ITBs, a carbon black having a relatively high electrical conductivity must be used in sufficient quantity. For example, 15 wt % of carbon black can be added to PAI to achieve a desired surface resistivity. However, PAI becomes brittle with the addition of electrically conductive fillers such as carbon black. It has been found that PAI, when mixed with MWCNT in the quantities discussed, is sufficiently break resistant and flexible for use as an ITB.

Thus the formation of the ITB can include varying amounts of the materials as discussed above. Table 4 shows the percentages, by weight, of each of the materials used in the solution for preparation of ITB samples D, E, and F.

TABLE 4

| % of Components by Weight | | | |
|---|---|---|---|
| | Sample D | Sample E | Sample F |
| 25% Torlon 4000T in NMP | 65.79 | 68.03 | 69.77 |
| StepFac-8171 | 0.66 | 0.68 | 0.70 |
| Fluorosurfactant FC-4432 | 0.11 | 0.11 | 0.12 |
| 1% Nanosolve MWCNT Solution | 11.51 | 8.50 | 6.16 |
| NMP | 21.93 | 22.68 | 23.26 |

The PAI component (i.e., Torlon) includes 75 wt % NMP and the CNT component (Nanosolve) includes 99 wt % methyl chloride as a solvent. Table 5 lists the total wt % of each material for samples D, E, and F.

TABLE 5

| Material Weight % | | | |
|---|---|---|---|
| | Sample D | Sample E | Sample F |
| PAI | 16.45 | 17.00 | 17.44 |
| StepFac-8171 | 0.66 | 0.68 | 0.70 |
| Fluorosurfactant FC-4432 | 0.11 | 0.11 | 0.12 |
| MWCNT | 0.12 | 0.09 | 0.06 |
| Solvent (Methyl Chloride) | 11.40 | 8.42 | 6.10 |
| NMP | 71.27 | 73.70 | 75.58 |

Generally, the liquid coating solution dispensed or applied onto the stainless steel substrate can be prepared by milling the components for a duration of time to sufficiently mix the materials. The liquid coating solution can be milled in the presence of a milling medium such as stainless steel beads, or another mixing procedure can be used. The milling process used in the mixing can aid carbon nanotube dispersion within the PAI resin.

The solution itself can be prepared by providing the components together within a solution. The PAI component can include a solution of 25 wt % of PAI and 75 wt % of NMP. The PAI component can be provided within the solution as a percentage, by weight, of between about 60 wt % and about 80 wt %, or between about 65 wt % and about 70 wt %, or between about 67.5 wt % and about 68.5 wt %. It will be understood that if each of the PAI, MWCNT, solvent (e.g., NMP), non-ionic surfactant, ionic surfactant, and solvents are mixed as separate material or have different starting wt % (i.e., not using premixed Torlon or Nanosolve), adjustment of the material quantities to result in an equivalent final wt % as described can be performed to produce the liquid coating solution and the ITB.

The non-ionic surfactant, for example Stepfac-8171, can be provided within the solution as a percentage, by weight, of between about 0.50 wt % and about 0.90 wt %, or between about 0.60 wt % and about 0.75 wt %, or between about 0.65 wt % and about 0.70 wt %.

The non-ionic surfactant such as a fluorosurfactant, for example Novec FC-4432, can be provided within the solution of between about 0.05 wt % and about 0.15 wt %, or about 0.10 wt % and about 0.13 wt %, or about 0.11 wt %.

The MWCNT component can include 1 wt % of MWCNT and 99 wt % of a solvent such as methylene chloride. The MWCNT component can be provided within the solution as a percentage, by weight, of between about 6.0 wt % and about 12.0 wt %, or between about 7.0 wt % and about 11.0 wt %, or between about 8.0 wt % and about 9.0 wt %.

The solvent, for example NMP, can be provided within the solution as a percentage, by weight, of between about 18.0 wt % and about 26.0 wt %, or about 21.0 wt % and about 24.0 wt %, or between about 22.0 wt % and about 23.0 wt %.

Once the solution is milled or mixed using another mixing process, the milling medium is removed, for example by filtering, and the milled solution is collected and coated onto the solid substrate, for example by coating the solution onto the solid substrate to a sufficient thickness that the resulting ITB, after drying, will have a thickness of between about 0.1 mil and about 10 mil, for example between about 1 mil and about 6 mil, or another suitable thickness. The solution which coats the solid substrate can be dried or cured, for example using the application of heat. In one process, a first heating stage can include placing the solution and solid substrate into a heat chamber, and ramping the temperature within the chamber to a first target temperature of between about 75° C. and about 95° C., or between about 80° C. and about 90° C., or about 85° C. The solid substrate and liquid coating solution are heated within the chamber at the first target temperature for duration of between about 25 minutes and about 35 minutes, or about 30 minutes. This can be followed by a second heating stage, which can include ramping the chamber temperature to a second target temperature of between about 180° C. and about 200° C., or about 190° C. The solid substrate and liquid coating solution are heated within the chamber at the second target temperature for a duration of between about 40 minutes and about 50 minutes, or about 45 minutes. Other drying and curing processes can be used to remove the volatile components from the liquid coating solution to result in a cured liquid coating solution, and an ITB, which is solid and flexible.

The composition of the ITB which is ready for use can have a composition. For example, the ITB can include a cured PAI of between about 10 wt % and about 99.9 wt %, or about 20 wt % and about 99.6 wt %, or about 50 wt % and about 99.5 wt %. The ITB can further include CNT, for example MWCNT, of between about 0.01 wt % and about 10 wt %, or between about 0.05 wt % and about 8.0 wt %, or between about 0.1 wt % and about 6.0 wt %. Additionally, the ITB can optionally include surfactant and/or release agent such as Stepfac-8171 and FC-4432 from about 0.001% to about 10%, or from about 0.005% to about 8%, or from about 0.01% to about 5%.

The ITB formed according to the present teachings can have a break strength of between about 30 MPa and about 1000 MPa, or between about 40 MPa and about 500 MPa, or between about 50 MPa and about 200 MPa. Additionally, the ITB can have a Young's modulus of between about 1000 MPa and about 10000 MPa, or between about 2000 MPa and about 9000 MPa, or between about 3000 MPa and about 8000 MPa. Further, the ITB can have a surface resistivity at 1000 volts of between about 1.0E+05Ω/□ and about 1.0E+13Ω/□, or between about 1.0E+06Ω/□ and about 1.0E+12Ω/□, or between about 1.0E+08Ω/□ and 1.0E+11Ω/□.

The ITB can be used in various electrostatographic devices such as printers, digital copiers, bookmaking machines, facsimile machines, multi-function machines, etc. FIG. 1 depicts an example of an electrostatographic apparatus, and in particular a color laser printer, having an intermediate transfer belt (ITB) in accordance with an embodiment of the present teachings. The printer 10 of FIG. 1 can include a housing 12 and at least one, or a plurality of color toner cartridges 14A-14D. Toner within the plurality color toner cartridges can be, for example, cyan, magenta, yellow and black (i.e., CMYK). The printer 10 can further include at least one, or a plurality of photoreceptors (i.e., drums) 16A-16D each configured to receive a latent image, and at least one, or a plurality of charging devices 18A-18D configured to write a latent image onto the at least one photoreceptor 16A-16D. The image forming apparatus can further include an intermediate transfer belt 20 configured to receive a toner image from the at least one photoreceptor and to transfer the toner image to a permanent substrate, a fuser belt 22, and a pressure roller 24. The fuser belt 22 is configured to fuse the toner image to the permanent substrate. A hopper 26 such as a paper tray can store a plurality of permanent substrates 28, such as sheets of plain paper, plastic, or other print media, collectively referred to herein for ease of explanation as "paper." The printer can further include a pickup roller 30 and an exit hopper or platform 32.

In use, image data containing pattern and color information is processed, for example by a microprocessor. A patterned latent electrostatic image corresponding to the pattern and color information is written onto one or more of the rotating photoreceptors 16A-16D using the corresponding charging device 18A-18D. The latent electrostatic image on each photoreceptor 16A-16D attracts toner from the corresponding toner cartridge 14A-14D, to reproduce the patterned electrostatic image in color toner on the photoreceptor 16A-16D. The toner is then transferred from each photoreceptor 16A-16D to the intermediate transfer belt 20. A paper sheet 28 is removed from the tray 26 by the pickup roller 30. The toner image is transferred to the paper 28 through pressure contact with the intermediate transfer belt 20. The image is then fixed or fused to the paper with heat supplied by the fuser belt 22 and through pressure between the fuser belt 22 and the pressure roller 24. After fixing the image onto the paper 28, the paper 28 can be transferred to the exit tray 30.

A printer can include additional structures and image forming can include additional materials and processes which have not been described for simplicity of explanation.

Embodiments can thus include an intermediate transfer belt, methods for forming the intermediate transfer belt, and electrostatographic devices including the intermediate transfer belt. The ITB can be formed at a reasonable cost and provide good operating characteristics.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

In embodiments, the disclosed ITBs and method of their formation can include the materials and methods disclosed in co-pending U.S. patent application Ser. No. 12/624,589, filed Nov. 24, 2009, and entitled "UV Cured Heterogeneous Intermediate Transfer Belts (ITB)," and Ser. No. 12/731,449, filed Mar. 25, 2010, and entitled "Intermediate Transfer Belts," which are hereby incorporated by reference in their entireties.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

The invention claimed is:

1. A method for forming an intermediate transfer belt, comprising:

forming a liquid coating solution using a method comprising combining a polyamide-imide component comprising a first mixture of about 25 wt % polyamide-imide and about 75 wt % of a first solvent with a carbon nanotube component comprising a second mixture of about 1 wt % carbon nanotubes and about 99 wt % of a second solvent, wherein the polyamide-imide component within the liquid coating solution comprises between about 60 wt % and about 80 wt % of the liquid coating solution and the carbon nanotube component within the liquid coating solution comprises between about 6.0 wt % and about 12.0 wt % of the liquid coating solution;

applying the liquid coating solution to a solid substrate;

curing the liquid coating solution; and removing the cured liquid coating solution from the solid substrate.

2. The method of claim 1, further comprising:

combining a non-ionic surfactant with the liquid coating solution, wherein the non-ionic surfactant within the liquid coating solution comprises between about 0.50 wt % and about 0.90 wt % of the liquid coating solution.

3. The method of claim 2, further comprising:

combining an ionic surfactant with the liquid coating solution, wherein the ionic surfactant within the liquid coating solution comprises between about 0.05 wt % and about 0.15 wt % of the liquid coating solution.

4. The method of claim 3, further comprising:

combining a third solvent with the liquid coating solution, wherein the third solvent combined with the liquid coating solution comprises between about 18.0 wt % and about 26.0 wt % of the liquid coating solution.

5. The method of claim 4, further comprising:

subsequent to combining the polyamide-imide component, the carbon nanotube component, the non-ionic surfactant, the ionic surfactant, and the third solvent, milling the liquid coating solution using a milling medium;

filtering off the milling medium from the liquid coating solution; and dispensing the liquid coating solution onto the solid substrate.

6. The method of claim 5 wherein the solid substrate is a stainless steel substrate and the method, further comprises:

curing the dispensed liquid coating solution on the stainless steel substrate using a method comprising:

placing the stainless steel substrate and liquid coating solution into a heat chamber;

ramping the temperature within the chamber to a first target temperature of between about 75° C. and about 95° C.;

heating the liquid coating solution within the chamber at the first target temperature for a duration of between about 25 minutes and about 30 minutes;

ramping the temperature within the chamber to a second target temperature of between about 180° C. and about 200° C.; and heating the liquid coating solution for a duration of between about 40 minutes and about 50 minutes; and removing the cured liquid coating solution from the stainless steel substrate.

7. An intermediate transfer belt for an electrostatographic image forming device, comprising:

a polyamide-imide comprising between about 10 wt % and about 99.9 wt % of the intermediate transfer belt; and a plurality of carbon nanotubes comprising between about 0.01 wt % and about 6.0 wt % of the intermediate transfer belt, wherein the intermediate transfer belt has a Young's modulus of between about 1000 MPa and about 10000 MPa.

8. The intermediate transfer belt of claim 7, wherein the plurality of carbon nanotubes comprises a material selected from the group consisting of multi-walled carbon nanotubes, single-walled carbon nanotubes, graphene, graphite, and combinations of two or more of these.

9. The intermediate transfer belt of claim 8, further comprising:

the polyamide-imide comprises between about 20 wt % and about 99.6 wt % of the intermediate transfer belt; and the plurality of carbon nanotubes comprises between about 0.05 wt % and about 8.0 wt % of the intermediate transfer belt.

10. The intermediate transfer belt of claim 8, wherein:

the polyamide-imide comprises between about 50 wt % and about 99.5 wt % of the intermediate transfer belt; and the plurality of carbon nanotubes comprises between about 0.1 wt % and about 6.0 wt % of the intermediate transfer belt.

11. The intermediate transfer belt of claim 7, wherein a break strength of the intermediate transfer belt is between about 30 MPa and about 1000 MPa.

12. The intermediate transfer belt of claim 7, wherein a surface resistivity of the intermediate transfer belt at 1000 volts is between about 1.0E+05Ω/□ and about 4E+13Ω/□.

13. The intermediate transfer belt of claim 7, wherein:

a break strength of the intermediate transfer belt is between about 30 MPa and about 1000 MPa;

a Young's modulus of the intermediate transfer belt is between about 1000 MPa and about 10000 MPa; and a surface resistivity of the intermediate transfer belt at 1000 volts is between about 1.0E+05Ω/□ and about 4E+13Ω/□.

14. The intermediate transfer belt of claim 7, wherein:

a break strength of the intermediate transfer belt is between about 40 MPa and about 500 MPa;

a Young's modulus of the intermediate transfer belt is between about 2000 MPa and about 9000 MPa; and a surface resistivity of the intermediate transfer belt at 1000 volts is between about 1.06E+06Ω/□ and about 3.75E+12Ω/□.

15. The intermediate transfer belt of claim 7, wherein:

a break strength of the intermediate transfer belt is between about 50 MPa and about 200 MPa;

a Young's modulus of the intermediate transfer belt is between about 3000 MPa and about 8000 MPa; and a surface resistivity the intermediate transfer belt at 1000 volts is between about 1.0E+08Ω/□ and about 1.0E+11Ω/□.

16. An electrostatographic image forming apparatus, comprising:

an intermediate transfer belt, comprising:

a polyamide-imide comprising between about 10 wt % and about 99.9 wt % of the intermediate transfer belt; and a plurality of carbon nanotubes comprising between about 0.01 wt % and about 6.0 wt % of the intermediate transfer belt, wherein the intermediate transfer belt has a Young's modulus of between about 1000 MPa and about 10000 MPa;

at least one photoreceptor configured to receive a latent image; and at least one charging device configured to write the latent image onto the at least one photoreceptor, wherein the intermediate transfer belt is configured to receive a toner image from the at least one photoreceptor.

17. The electrostatic image forming apparatus of claim 16, wherein the intermediate transfer belt further comprises:

the polyamide-imide comprises between about 20 wt % and about 99.6 wt % of the intermediate transfer belt; and the plurality of carbon nanotubes comprises between about 0.05 wt % and about 8.0 wt % of the intermediate transfer belt.

18. The electrostatic image forming apparatus of claim 16, wherein the intermediate transfer belt further comprises:

the polyamide-imide comprises between about 50 wt % and about 99.5 wt % of the intermediate transfer belt; and the plurality of carbon nanotubes comprises between about 0.1 wt % and about 6.0 wt % of the intermediate transfer belt.

* * * * *